US008334031B2

(12) United States Patent
Ajdelsztajn et al.

(10) Patent No.: US 8,334,031 B2
(45) Date of Patent: Dec. 18, 2012

(54) WETTING RESISTANT MATERIAL AND ARTICLES MADE THEREWITH

(75) Inventors: Leonardo Ajdelsztajn, Niskayuna, NY (US); James Anthony Ruud, Delmar, NY (US); Dalong Zhong, Niskayuna, NY (US); Molly Maureen Gentleman, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 900 days.

(21) Appl. No.: 12/329,654

(22) Filed: Dec. 8, 2008

(65) Prior Publication Data

US 2010/0143620 A1 Jun. 10, 2010

(51) Int. Cl.
*B22F 7/02* (2006.01)

(52) U.S. Cl. ..... 428/34.5; 428/34.4; 428/539.5; 428/689; 428/698

(58) Field of Classification Search ..... 428/698, 428/539.5, 34.4, 34.5
See application file for complete search history.

(56) References Cited

U.S. PATENT DOCUMENTS

| | | | | |
|---|---|---|---|---|
| 3,710,854 | A * | 1/1973 | Staub | 165/111 |
| 3,941,903 | A * | 3/1976 | Tucker, Jr. | 427/451 |
| 5,059,491 | A | 10/1991 | Odani et al. | |
| 5,851,678 | A | 12/1998 | Hasz et al. | |
| 6,670,049 | B1 | 12/2003 | Schaeffer et al. | |
| 6,780,474 | B2 | 8/2004 | Smith et al. | |
| 7,361,386 | B2 | 4/2008 | Kim et al. | |
| 2005/0106384 | A1 | 5/2005 | Sambasivan et al. | |
| 2007/0009709 | A1 | 1/2007 | Krishnan et al. | |
| 2007/0031639 | A1 * | 2/2007 | Hsu et al. | 428/141 |
| 2007/0099027 | A1 * | 5/2007 | Krishnamurthy et al. | 428/698 |
| 2007/0135329 | A1 | 6/2007 | Wang et al. | |
| 2007/0141367 | A1 | 6/2007 | Darolia et al. | |
| 2008/0145528 | A1 * | 6/2008 | Deng et al. | 427/180 |
| 2008/0226879 | A1 * | 9/2008 | Strock et al. | 428/195.1 |

FOREIGN PATENT DOCUMENTS

| | | | |
|---|---|---|---|
| EP | 1160279 | A1 | 12/2000 |
| JP | 2258250 | A | 10/1990 |
| WO | WO2005003404 | A2 | 1/2005 |
| WO | WO2007040941 | A1 | 4/2007 |

OTHER PUBLICATIONS

D. Zhong, E. Mateev, I. Dahan, J.J. Moore, G.G.W.Mustoe, T. Ohno, J. Disam, S.Thiel; Wettability of NiAl, Ni]Al]N, Ti]B]C, and Ti]B]C]N films by glass at high temperatures; Surface and Coatings Technology 133]1342000.8]14.

V. G. Kayuk, A. D. Panasyuk, and O. N. Grigor'Ev; Reactions of Cr3C2—TiN System Materials With Nickel-Chromium Alloys; Powder Metallurgy and Metal Ceramics, vol. 45, Nos. 7-8, 2006.

* cited by examiner

*Primary Examiner* — Rena Dye
*Assistant Examiner* — Yan Lan
(74) *Attorney, Agent, or Firm* — Paul J. DiConza

(57) ABSTRACT

An article coated with a highly durable, wetting resistant coating is provided. The article comprises a coating that comprises a cermet material. The cermet material includes a nickel-bearing metal matrix and a phase disposed within the matrix. The phase includes an anion moiety, for example nitrogen, carbon, or boron; and a cation moiety, for example chromium, zirconium, titanium, vanadium, hafnium, niobium, or tantalum. The phase is present in the cermet at a level of at least about 5 volume %.

6 Claims, 5 Drawing Sheets

| Metals | Contact Angle (degrees) | Dropwise condensation |
|---|---|---|
| Al | 57 | No |
| Ti | 76 | No |
| Co | 116 | No |
| Cr | 65 | No |
| Ni | 100 | Yes |
| Ni5Cr | 97.3 | Yes |
| Ni10Cr | 95.7 | Yes |
| Ni15Cr | 95 | Yes |
| Stainless Steel | 76 | No |

FIG. 3

| Cermets | Contact Angle (degrees) | Dropwise condensation |
|---|---|---|
| WC/Ni | 56 | No |
| $Mo_2C$/Ni | 82 | No |
| TaC/Ni | 51.8 | No |
| TaN/Ni | 51.9 | No |
| TiN/Ni | 73 | Yes |
| ZrC/Ni | 72 | Yes |
| VC/Ni | 59.1 | Yes |
| NbC/Ni | 76.6 | Yes |
| NbN/Ni | 75.8 | Yes |
| $Cr_3C_2$/Ni | 98 | Yes |
| CrN-$Cr_2N$/Ni | 101 | Yes |

FIG. 4

WETTING RESISTANT MATERIAL AND ARTICLES MADE THEREWITH

STATEMENT REGARDING FEDERALLY SPONSORED RESEARCH & DEVELOPMENT

This invention was made with Government support under contract number 70NANB7H7009 awarded by the U.S. NIST Advanced Technology Program. The Government may have certain rights in the invention.

BACKGROUND OF INVENTION

This invention relates generally to a coated article. More particularly, the invention relates to an article having a composite coating formed of a mixture of a metal and a ceramic so as to have low liquid wettability.

The "liquid wettability", or "wettability," of a solid surface is determined by observing the nature of the interaction occurring between the surface and a drop of a given liquid disposed on the surface. A high degree of wetting results in a relatively low solid-liquid contact angle and large areas of liquid-solid contact; this state is desirable in applications where a considerable amount of interaction between the two surfaces is beneficial, such as, for example, adhesive and coating applications. By way of example, so-called "hydrophilic" materials have relatively high wettability in the presence of water, resulting in a high degree of "sheeting" of the water over the solid surface. Conversely, for applications requiring low solid-liquid interaction, the wettability is generally kept as low as possible in order to promote the formation of liquid drops having high contact angle and thus minimal contact area with the solid surface. "Hydrophobic" materials have relatively low water wettability (contact angle generally at or above 90 degrees); so-called "superhydrophobic" materials (often described as having a contact angle greater than 120 degrees) have even lower water wettability, where the liquid forms nearly spherical drops that in many cases easily roll off of the surface at the slightest disturbance.

Heat transfer equipment, such as condensers, provide one example of an application where the maintenance of surface water as droplets rather than as a film is important. Two alternate mechanisms may govern a condensation process. In most cases, the condensing liquid ("condensate") forms a film covering the entire surface; this mechanism is known as filmwise condensation. The film provides a considerable resistance to heat transfer between the vapor and the surface, and this resistance increases as the film thickness increases. In other cases, the condensate forms as drops on the surface, which grow on the surface, coalesce with other drops, and are shed from the surface under the action of gravity or aerodynamic forces, leaving freshly exposed surface upon which new drops may form. This so-called "dropwise" condensation results in considerably higher heat transfer rates than filmwise condensation, but dropwise condensation is generally an unstable condition that often becomes replaced by filmwise condensation over time. Efforts to stabilize and promote dropwise condensation over filmwise condensation as a heat transfer mechanism in practical systems have often required the incorporation of additives to the condensing medium to reduce the tendency of the condensate to wet (i.e., form a film on) the surface, or the use of low-surface energy polymer films applied to the surface to reduce film formation. These approaches have drawbacks in that the use of additives may not be practical in many applications, and the use of polymer films may insert significant thermal resistance between the surface and the vapor. Polymer films may also suffer from low adhesion and durability in many aggressive industrial environments.

Texturing or roughening the surface can change the contact angle of water on a surface. A texture that increases the tortuosity of the surface but maintains the contact between water droplet and the surface will increase the contact angle of a hydrophobic material and decrease the contact angle of a hydrophilic material. In contrast, if a texture is imparted that maintains regions of air beneath a water droplet, the surface will become more hydrophobic. Even an intrinsically hydrophilic surface can exhibit hydrophobic behavior if the surface is textured to maintain a sufficiently high fraction of air beneath the water drop. However, for applications requiring highly hydrophobic or superhydrophobic behavior, it is generally more desirable in practice to texture a hydrophobic surface than to texture a hydrophilic surface. An intrinsically hydrophobic surface usually provides the potential for a higher effective contact angle after texturing than an intrinsically hydrophilic surface, and generally provides for a higher level of wetting resistance even if the surface texturing becomes less effective over time as the texture wears away.

Relatively little is known about the intrinsic hydrophobicity of broad classes of materials. In general, most of the materials known to have a contact angle with water of greater than 90 degrees are polymers such as tetrafluoroethylene, silanes, waxes, polyethylene, and propylene. Unfortunately, polymers have limitations in temperature and durability that can limit their application, because many practical surfaces that would benefit from low wettability properties are subject in service to high temperatures, erosion, or harsh chemicals.

Therefore, there remains a need in the art for materials and coatings that have lower liquid wettability than most conventional engineered materials, promote stable dropwise condensation, are stable at elevated temperatures, are amenable to coating processing, and have good mechanical properties.

SUMMARY OF INVENTION

The present invention meets these and other needs by providing an article having a cermet coating. The coated surface provides high durability and low liquid wettability along with other properties that may include, as non-limiting examples, the ability to promote stable dropwise condensation.

Accordingly, one aspect of the invention is an article. The article comprises a coating that comprises a cermet material. The cermet material includes a metal matrix and a phase disposed within the matrix. The metal matrix includes nickel and the phase includes an anion moiety and a cation moiety, wherein the anion moiety comprises nitrogen, carbon, boron, or a combination thereof, and the cation moiety comprises zirconium, titanium, vanadium, hafnium, niobium, or tantalum or combinations thereof, wherein the phase is present in the cermet material at a level of at least 5 volume %.

Another aspect of the invention is to provide an article comprising a coating. The coating comprises a cermet material, which includes a metal matrix and a phase disposed within the matrix. The metal matrix comprises nickel and an amount of chromium that is less than about 10 wt % of the matrix. The said phase comprises carbon, nitrogen, or boron, or combinations thereof; and a cation moiety wherein the cation moiety comprises chromium, zirconium, titanium, vanadium, hafnium, niobium, or tantalum, or combination thereof.

Still another aspect of the invention is to provide a device comprising a chamber enclosing a fluid flow path between an inlet and an outlet; and a surface disposed within the flow path, the surface comprising a cermet material, wherein the cermet material comprises a metal matrix comprising nickel; and a phase disposed within the matrix, the phase comprising an anion moiety and a cation moiety wherein the anion moiety comprises nitrogen, boron, or carbon, or a combination thereof, and the cation moiety comprises chromium, zirconium, titanium, vanadium, hafnium, niobium, or tantalum or combination thereof.

These and other aspects, embodiments, advantages, and salient features of the present invention will become apparent from the following detailed description, accompanying drawings, and appended claims.

BRIEF DESCRIPTION OF THE DRAWINGS

FIG. 3 is a table representing contact angles of water on polished surfaces of different metals.

FIG. 4 is a table representing contact angles of water on polished surfaces of cermets prepared using Nickel as the matrix.

DETAILED DESCRIPTION

Figure 1:
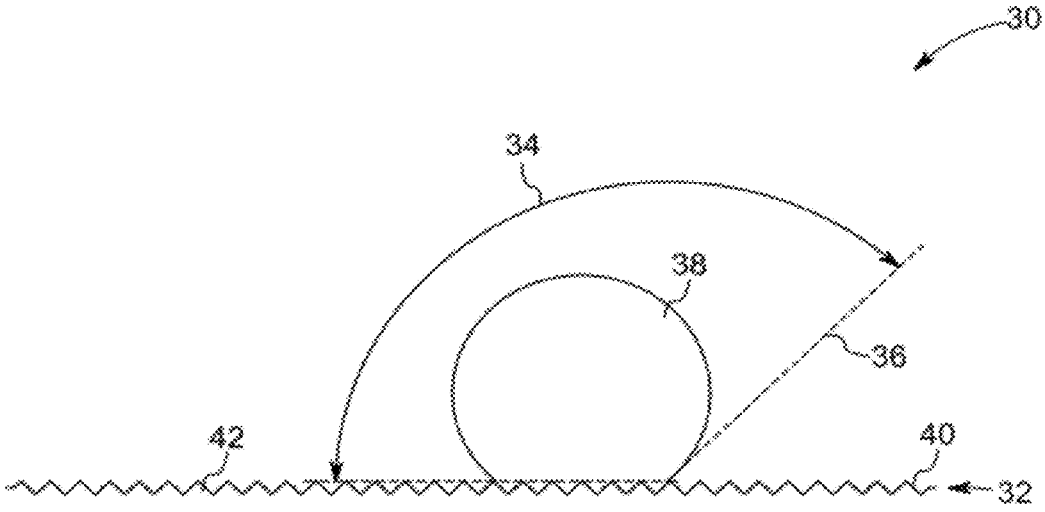
FIG. 1 is a schematic cross-sectional view of a surface of an article of the present invention and a fluid disposed on it.

In the following description, like reference characters designate like or corresponding parts throughout the several views shown in the figures. It is also understood that terms such as "top," "bottom," "outward," "inward," and the like are words of convenience and are not to be construed as limiting terms. Furthermore, whenever a particular feature of the invention is said to comprise or consist of at least one of a number of elements of a group and combinations thereof, it is understood that the feature may comprise or consist of any of the elements of the group, either individually or in combination with any of the other elements of that group.

Cermet materials, which incorporate a ceramic phase within a metal matrix, are durable materials that combine the hardness of a ceramic phase with the ductility and toughness of a metal. These materials tend to be amenable to coating processing like thermal spray and, depending on proper materials selection, may be stable at elevated temperatures. The right combination of ceramic phase and metal matrix may provide durable surfaces that, when roughened or textured, could be used to impart superhydrophobic behavior in a range of applications.

In accordance with embodiments of the present invention, it has been determined that providing a coating comprising a cermet material having a metal matrix comprising nickel and a non-oxide phase disposed within that matrix provides a low-wettability surface even in the absence of mechanical surface texture. The wettability of the surface can be further reduced using the surface texture. The details of such cermet materials are described in the subsequent embodiments.

In accordance with one embodiment of the invention, an article with a coating is provided. The base or substrate surface for the coating may include any of the wide variety of materials and structures commonly used for different applications. Further selection on the substrates can be made by matching the ambient conditions and performance requirement of the substrate surfaces at different point of operations of the said article. The ambient conditions can vary in terms of temperature, pressure and the surrounding atmosphere while the performance requirements can include the required strength, malleability, ductility, erosion resistance, chemical and physical compatibility with the other parts etc.

The coating can be applied using any method that is capable of providing a suitably dense coating. Examples for such methods include, but are not limited to, thermal spray, chemical vapor deposition (CVD), and slurry coating. The coating thickness can vary from about 100 nm to a few millimeters depending on the application requirement.

FIG. 1 is a schematic cross-sectional view of a surface of an article of the present invention. Article 30 comprises a coated surface 32. A commonly accepted measure of the liquid wettability of a surface 32 is the value of the static contact angle 34 formed between surface 32 and a tangent 36 to a surface of a droplet 38 of a reference liquid at the point of contact between surface 32 and droplet 38. The reference liquid may be any liquid of interest. In many applications, the reference liquid is water; for instance, in applications focused on reducing the accretion of ice on a surface, the reference liquid is supercooled water (liquid water at a temperature below its freezing point). In other applications, the reference liquid is a liquid that contains at least one hydrocarbon, such as, for example, oil, petroleum, gasoline, an organic solvent, and the like. As described above, the term "superhydrophobic" is used to describe surfaces having very low wettability for water. As used herein, the term "superhydrophobic" will be understood to refer to a surface that generates a static contact angle with water of greater than about 120 degrees. Because wettability depends in part upon the surface tension of the reference liquid, a given surface may have a different wettability (and hence form a different contact angle) for different liquids.

Figure 2:
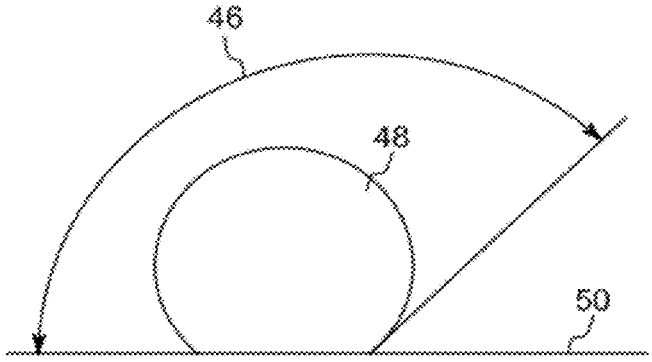
FIG. 2 is a schematic representation of a fluid disposed on a nominally flat surface of an article of the present invention.

In some embodiments, surface 32 further comprises a texture 40 comprising a plurality of features 42, often less than 10 microns, and some times even less than sub-micron in size scale, which aids in having lower wettability than that is inherent to the material from which the coated surface is made. However, in the present invention, surface 32 comprises a cermet that has intrinsically low wettability for a water droplet. In particular, surface 32 comprises a cermet having a nominal wettability sufficient to generate a nominal contact angle greater than about 70° with a water droplet. For the purposes of understanding the invention, a "nominal contact angle" (FIG. 2) means the static contact angle 46 measured where a drop of water 48 is disposed on a flat, smooth surface 50 consisting of the cermet material. A smooth surface has a surface tortuosity <1.05, wherein tortuosity is defined as the actual area divided by the projected area. This nominal contact angle 46 is a measurement of the "nominal wettability" of the material in void of any surface texture. Because of the intrinsic low wettability of the cermet materials used for the coating, even if the textures of the surface wear out during operation, the surface may still be hydrophobic, providing a measure of durability to the coating.

In one embodiment, the coating includes a cermet material that comprises a metal matrix and a phase disposed within the matrix. The metal matrix includes nickel, which was observed, surprisingly, to promote dropwise condensation and to have comparatively low wettability relative to other common metals. FIG. 3 represents a table containing a non-exhaustive list of experimental data of contact angle and observations about condensation characteristics on some metals of possible use in certain applications. Single droplet contact angles were measured on polished surfaces of the selected metals. Condensation characteristics such as dropwise condensation or filmwise condensation were observed by exposing the metal surfaces to steam. From the table, Ni appears to be an attractive selection as a component of the metal matrix due to its good hydrophobic properties—not only high contact angle, but also for its ability to promote dropwise condensation. Co metal was also found to be hydrophobic but promotes filmwise condensation.

In one embodiment, the metal matrix comprises nickel in an amount of at least about 75 weight % relative to the metal matrix material. In another embodiment the nickel is in an amount greater than 80 weight % of the matrix material and in yet another embodiment the nickel is in an amount more than about 90% of the metal matrix material. In one more embodiment, the metal matrix essentially consists of pure nickel.

The phase disposed within the metal matrix includes an anion moiety and a cation moiety. The anion moiety comprises nitrogen, carbon, boron or a combination thereof, and the cation moiety comprises zirconium, titanium, vanadium, hafnium, niobium, or tantalum or combinations thereof. The phase is present in the cermet at a level of at least about 5 volume %. In certain embodiments, the phase is present in the cermet material at a level of at least about 50 volume %.

In accordance with one embodiment of the invention, the phase is dispersed in the metal matrix, for example in the form of plurality of particles dispersed within the matrix. In one embodiment the plurality of particles has a median particle size of up to about 50 microns. In another embodiment the median size of the pluarality of particles is up to about 10 microns and in yet another embodiment the median size is up to about 5 microns. In another embodiment the cermet coating comprises a surface texture having a plurality of features with a size scale less than about 10 microns. In another particular embodiment the features of the surface texture are in the sub-micron range, measuring up to about 1 micron.

Characterization of ceramic materials to test their potential as candidates for use as phases in the cermet described herein is conducted either on the ceramic phase surfaces itself or on cermet materials prepared by mixing different ceramic materials with some identified, promising hydrophobic metals. These materials can be deposited in coating form with, for instance, conventional thermal spray techniques. The contact angle and condensation characteristics were measured on such ceramic or cermet surfaces.

FIG. 4 represents a table containing a non-exhaustive list of experimental data of contact angle and observation about condensation behavior on some ceramics and cermet surfaces. $Cr_3C_2$ and $CrN/Cr_2N$ have shown contact angles close to 100° when mixed and sintered with 20 wt % Ni. These surfaces can be further roughened in order to increase the contact angle and achieve greater superhydrophobicity. Additionally, the Ni matrix can be modified through various means including etching to obtain different roughness on the surface and also to remove Ni oxide, which is detrimental to the hydrophobic properties of the cermet.

In one embodiment, the cation moiety of the phase includes zirconium, titanium, vanadium, hafnium, niobium, or tantalum or combinations of them. In another embodiment the cation moiety contains zirconium, titanium, or vanadium or their any combination. The anion moiety of the phase of the present inventions can contain nitrogen, carbon, boron or any combinations of them. Accordingly in one embodiment the phase contains a nitride, or a carbide, or a boride. In another embodiment the phase contains a carbonitride, or a boronitride, or a borocarbide, or a carboboronitride. In yet another embodiment the phase comprises titanium carboboronitride.

In accordance with another embodiment of the present invention, an article with a coating comprising a cermet material having a metal matrix and a phase dispersed within the matrix is provided. The metal matrix comprises nickel, and the content of chromium in the metal matrix is less than about 10 wt % of the matrix. The phase comprises carbon, nitrogen or boron or any combinations of these, along with one or more cation moieties such as chromium, zirconium, titanium, vanadium, hafnium, niobium, or tantalum, or any combination of said cation moieties. The anion moiety of the phase of the present inventions can contain nitrogen, carbon, boron or any combinations of them. Accordingly in one embodiment the phase contains a nitride, or a carbide, or a boride. In another embodiment the phase contains a chromium carbide, or a chromium nitride. In yet another embodiment the phase comprises chromium boronitride. The percentage of the phase present in the cermet material, the amount of nickel present in the metal matrix and the size of the plurality of particles dispersed in the matrix are as described in the earlier paragraphs.

Figure 5:
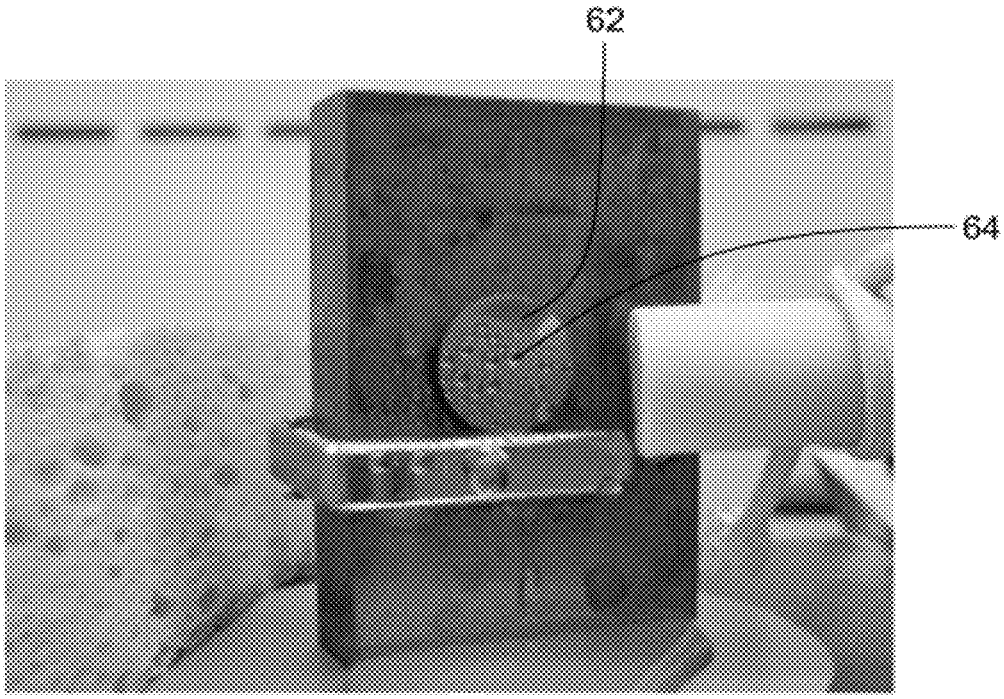
FIG. 5 is a photograph of a water droplet on a nominally flat surface of cermet prepared using Nickel as the matrix

An example of the behavior of a fluid drop on an article of the present invention is shown in FIG. 5. 20 volume % of nickel powder of about 2.2 to about 3 micron size was mixed with $CrN—Cr_2N$ powder by dry mixing. 3 g of this powder was put into a 15 mm diameter graphite die. The powder was sintered to nearly full density using spark plasma sintering with pressure of about 60 MPa and temperature of about 1100° C. for 5 minutes. The sample surface was polished to about 1 microns finish. The contact angle was measured using static sessile drop technique and the surface was exposed to steam to evaluate the mode of condensation. In FIG. 5, surface 62 of the cermet material clearly portrays dropwise condensation. The contact angle formed by water droplet 64 and surface 62 is about 101°. By providing the required surface texture, the contact angle may be elevated to greater than 120°.

Alternatively, surface 62 can be formed by a layer that is disposed or deposited onto a substrate by techniques such as, but not limited to HVOF, HVAF and cold spray.

Figure 6:
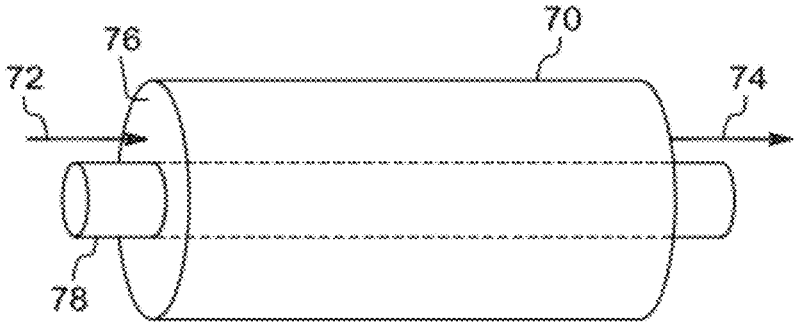
FIG. 6 is a schematic representation of an exemplary device of one embodiment of the present invention.

The articles described herein can be used in a variety of applications where the material properties of the cermet coating provide an advantageous performance. The novel properties described for the above embodiments lend themselves to a host of useful applications where resistance to wetting by liquids is desirable. The superhydrophobic nature of a cermet-coated surface makes it suitable for a number of applications that require resistance to fogging, soiling, contamination, and icing. For example, the articles having the present cermet surfaces may be used in applications wherein a surface that has low wettability and promotes dropwise condensation properties is desirable, such as, but not limited to, a condenser assembly, a turbine component or a turbine assembly comprising the said turbine component. Cermet coated surfaces can also be used in heat transfer applications, such as, but not limited to, heat exchangers, cooling towers, and other thermal-management systems, that rely on a phase change (e.g., boiling). Air bubbles on these surfaces nucleate at a higher rate than on a nominally flat surface, facilitating heat transfer through the phase change and bubble formation and migration One embodiment of the present invention is a device (FIG. 6). The device comprises a chamber 70 enclosing a fluid flow path between an inlet 72 and an outlet 74 wherein a surface 76 is disposed within the flow path. The said surface comprises any of the cermet materials described above.

In one embodiment of the present device (FIG. 6), the fluid passing through the fluid flow path consists essentially of liquid phases. In another embodiment a hollow component 78 is disposed within the said flow path wherein the surface of the hollow component containing the said cermet material is an external surface of the hollow component. In another embodiment of the device, the said device is a surface condenser and the surface containing the said material is disposed on an external surface of at least one condenser tube of the surface condenser.

Figure 7:
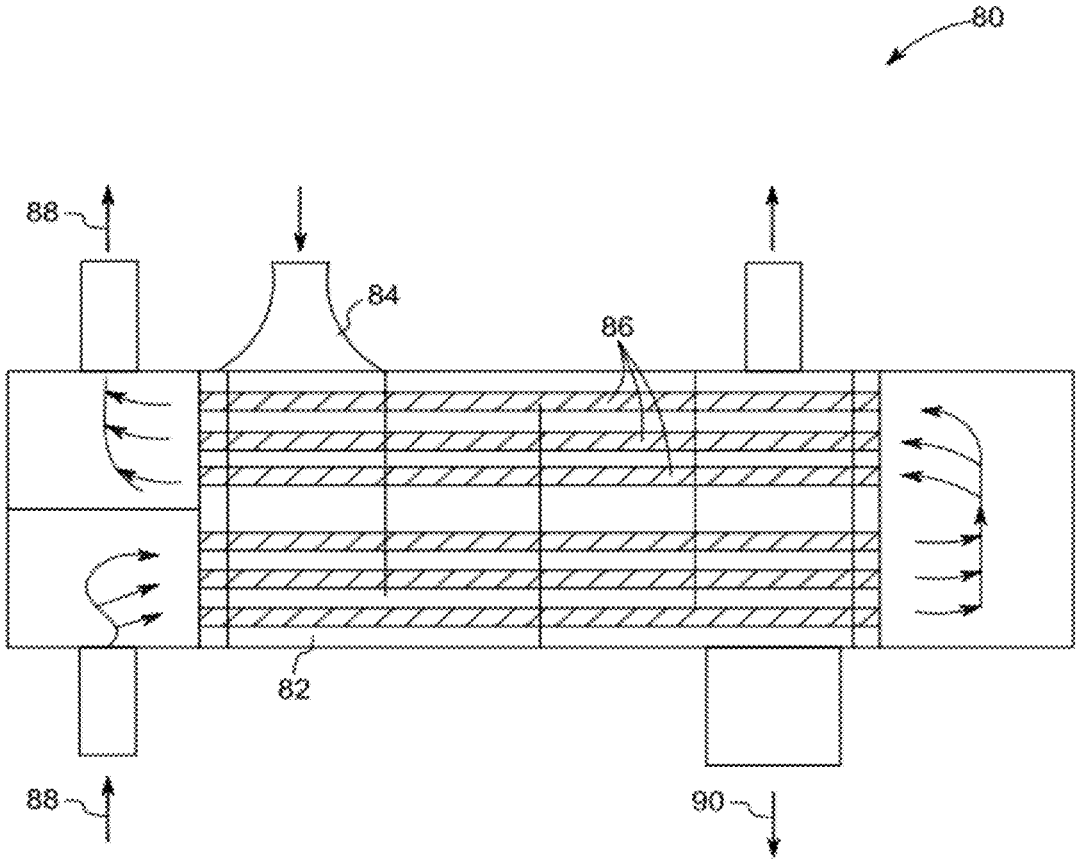
FIG. 7 is a schematic representation of a surface condenser of one embodiment of the present invention.

A condenser is used, for instance, to transfer heat between a hot vapor and a cooling fluid, such as is used in chemical processing, water desalination, and power generation and is an example of an embodiment of the present invention using the articles and materials described above. FIG. 7 illustrates one common type of condenser: the surface condenser 80. Steam, for example, enters shell 82 through inlet 84, whereupon it is condensed to water on the exterior surface of condensation tubes 86, through which flows a cooling fluid 88, such as water. The material (not shown) described above is disposed on this exterior surface of the condensation tubes 86, thereby promoting dropwise condensation of condensate water from the steam. The condensate is easily shed from the tubes 86 by the material and exits from shell 82 via condensate outlet 90.

In certain applications, such as, for example, steam turbines, metal components are subject to impinging drops of water as well as condensing drops. As steam expands in a turbine, water droplets (typically fog-sized) appear in the flow stream. These droplets agglomerate on the turbine blades and other components and shed off as larger drops that can cause thermodynamic, aerodynamic, and erosion losses in turbines. The ability to shed water droplets from components before they have a chance to agglomerate into substantially larger drops is thus important to maximize system lifetime and operation efficiency. As noted above, many of the compositions applied in embodiments of the present invention promote dropwise condensation, so that liquid is shed from the surface in small drops rather than in larger sheets. Accordingly, embodiments of the present invention include a steam turbine assembly comprising the article described above. In particular embodiments, the article is a component of a steam turbine assembly, such as a turbine blade, a turbine vane, or other component susceptible to impingement of water droplets during turbine operation.

In one embodiment, the cermet coating primarily provides article with an increased resistance to "icing:" the formation and accretion of ice through deposition and freezing of supercooled water droplets on a surface. In this embodiment, the article is an airfoil, such as, but not limited to, aircraft wings, propellers, low pressure compressor and fan components of gas turbine engines, wind turbine blades, and helicopter blades—articles that are particularly susceptible to icing under certain conditions.

While typical embodiments have been set forth for the purpose of illustration, the foregoing description should not be deemed to be a limitation on the scope of the invention. Accordingly, various modifications, adaptations, and alternatives may occur to one skilled in the art without departing from the spirit and scope of the present invention.

The invention claimed is:

1. A device comprising:

a chamber enclosing a fluid flow path between an inlet and an outlet; and a surface disposed within the flow path, the surface comprising a cermet material, wherein the material comprises a metal matrix comprising nickel; and a phase of a plurality of particles disposed within the matrix, the phase comprising an anion moiety and a cation moiety wherein the anion moiety comprises a boronitride, or a carbonitride, and the cation moiety comprises chromium, zirconium, titanium, vanadium, hafnium, niobium, or tantalum, or combination thereof, wherein the plurality of particles has a median particle size of up to about 10 microns.

2. The device of claim 1, wherein the phase is present in the material at a level of at least about 50 volume %.

3. The device of claim 1, wherein the metal matrix comprises nickel in an amount at least about 50 weight % of the matrix.

4. The device of claim 1, wherein the content of chromium of the metal matrix is less than about 10 wt % of the matrix.

5. The device of claim 1, further comprising a hollow component disposed within the flow path, wherein the surface is an external surface of the hollow component.

6. The device of claim 1, wherein the device is a surface condenser and the surface is disposed on an external surface of at least one condenser tube of the surface condenser.

* * * * *